US007926479B2

(12) United States Patent
Johnson et al.

(10) Patent No.: US 7,926,479 B2
(45) Date of Patent: Apr. 19, 2011

(54) INFRARED WOK HEATER

(75) Inventors: Michael Frank Gray Johnson, Elmhurst, IL (US); Shawn Matthew Scott, Mount Prospect, IL (US); James Timothy Cole, Algonquin, IL (US)

(73) Assignee: Utilization Technology Development, NFP, Des Plaines, IL (US)

( * ) Notice: Subject to any disclaimer, the term of this patent is extended or adjusted under 35 U.S.C. 154(b) by 611 days.

(21) Appl. No.: 12/052,302

(22) Filed: Mar. 20, 2008

(65) Prior Publication Data

US 2009/0235922 A1 Sep. 24, 2009

(51) Int. Cl.
*F24C 3/04* (2006.01)

(52) U.S. Cl. ..... 126/92 AC; 126/39 R; 126/92 R; 126/373.1

(58) Field of Classification Search ..... 126/92 AC, 126/373.1, 39 R, 92 R, 271.1, 271.2 R; 431/347, 431/326

See application file for complete search history.

(56) References Cited

U.S. PATENT DOCUMENTS

| | | | |
|---|---|---|---|
| 4,313,416 | A | 2/1982 | Lau |
| 4,889,103 | A | 12/1989 | Fraioli |
| 5,345,062 | A | 9/1994 | Maudal |
| 6,718,967 | B2 | 4/2004 | Luther |

*Primary Examiner* — Alfred Basichas
(74) *Attorney, Agent, or Firm* — Mark E. Fejer

(57) ABSTRACT

An infrared heater for heating a cooking vessel, such as a Chinese wok. The heater includes a block of refractory material, which emits infrared radiation upon heating to an elevated temperature, forming an inverted frustum-shaped cavity or opening. A gas-fired burner having a burner head which produces a laterally directed flame upon ignition of a mixture of a fuel gas and a combustion oxidant supplied to the burner is disposed in the cavity or opening. A planar structure suitable for emitting infrared radiation upon heating to an elevated temperature and forming at least one centralized opening covers the upward oriented base end of the inverted frustum-shaped opening. In accordance with one embodiment, the refractory block is disposed within a cylindrical housing which supports the cooking vessel above the centralized opening during the cooking process.

9 Claims, 2 Drawing Sheets

INFRARED WOK HEATER

BACKGROUND OF THE INVENTION

1. Field of the Invention

This invention relates to infrared heaters in which a refractory body is heated by means of a gas-fired burner to an elevated temperature causing it to emit infrared radiation, and more particularly, to such infrared heaters adapted to provide heat energy to cooking vessels, such as bowl-shaped cooking woks.

2. Description of Related Art

Wok cooking involves the application of intense heat to a wok, a metal cooking vessel having a convex bottom. Typically, the heat is provided by a gas-fired burner. In a wok range, a wok cooking station typically consists of a cylindrical or tubular wok support that rises from a heat source such as a gas-fired burner through the top surface of the range. Conventional wok burners are generally only about 15-20% efficient.

Heat conduction through the range top is an inevitable consequence of the operation of a wok heater or burner. Wok cooking typically involves temperatures up to about 2100° F. in order to seal the flavor of the food being cooked and to bind the spices and accents to the food. During cooking, the heat generated by the burner is chimneyed upward through the wok support to the wok; however, a significant amount of heat is also conducted through the wok support to the range top resulting in potentially damaging and dangerous high range top temperatures. Conventionally, cooling means, such as the use of a cooling fluid, e.g. water, are used to reduce the range top temperatures. For continuously operating wok ranges, the amount of water employed may be substantial. One solution for eliminating the need for such cooling fluids is taught by U.S. Pat. No. 6,718,967 B2 to Luther. There, a refractory insulating material is incorporated into the support structure wherein the wok support includes a tubular support structure having internal space in its wall in which the refractory insulating material is disposed.

There are essentially three ways in which heat is transferred from a higher temperature source to a lower temperature receiver: conduction, convection, and radiation. Of these, radiant heating provides substantially instantaneous heating compared to the relatively slow heating afforded by convective heating and is potentially more efficient than either convective or conductive heat transfer. U.S. Pat. No. 4,889,103 to Fraioli teaches an infrared wok heater comprising a ribbon-type burner head fed with a pressurized mixture of air and gas that is expelled from the head through a cylindrical array of minute jet openings to produce an omnidirectional flame when ignited and comprising a block of refractory material which, when heated to an elevated temperature, emits infrared radiation. The block has superposed base, intermediate, and top sections, the base section having a cavity therein whose central zone communicates with central openings in the intermediate and top sections, and an outer zone which communicates with a circular array of bores in the intermediate and top sections. The burner head is disposed within the block of refractory material so that the flame projected from the lower portion of the cylindrical array impinges on the wall of the cavity in the base section, as a result of which infrared radiation is emitted through the bores to provide secondary beams, while the flame projected from the upper portion of the array impinges upon the wall of the opening in the intermediate section, as a result of which infrared radiation is emitted through the opening to provide a main beam. The wok is seated above the block so that the central portion of the wok is heated by the main beam and the peripheral region of the wok is heated by the outer beams.

SUMMARY OF THE INVENTION

It is one object of this invention to provide a wok heater with increased efficiencies compared with conventional wok heaters.

It is another object of this invention to provide a wok heater in which the amount of heat transferred into the wok range top is reduced compared with conventional wok heaters.

These and other objects and features of this invention are addressed by an infrared wok heater comprising a gas-fired burner having a burner head which produces a laterally directed flame upon ignition of a mixture of a fuel gas and a combustion oxidant supplied to the burner, a block of refractory material forming an inverted frustum-shaped cavity having a downward oriented apical opening and an upward oriented base opening defining a combustion chamber in which the burner head is disposed whereby the flame heats the block of refractory material to an elevated temperature at which the block of refractory wall emits infrared radiation, a planar structure disposed over the upward oriented base opening, which planar structure forms at least one exhaust gas opening for exhausting combustion products generated by the flame, seal means for sealing a periphery of the planar structure with the block of refractory material, whereby passage of the combustion products around the periphery of the planar structure is substantially precluded, and support means for supporting a wok above the planar structure such that the combustion products exhausted through the at least one exhaust gas opening impinge upon the bottom of the wok during cooking.

BRIEF DESCRIPTION OF THE DRAWINGS

These and other objects and features of this invention will be better understood from the following detailed description taken in conjunction with the drawings, wherein.

DETAILED DESCRIPTION OF THE PRESENTLY PREFERRED EMBODIMENTS

As used herein, the term "inverted frustum-shaped cavity" or "inverted frustum-shaped opening" refers to a cavity or opening having the shape of a frustum which has been turned upside down such that the normally smaller apical base plane of the frustum is oriented in a downward direction and the normally larger base plane is oriented in an upward direction.

Figure 1:
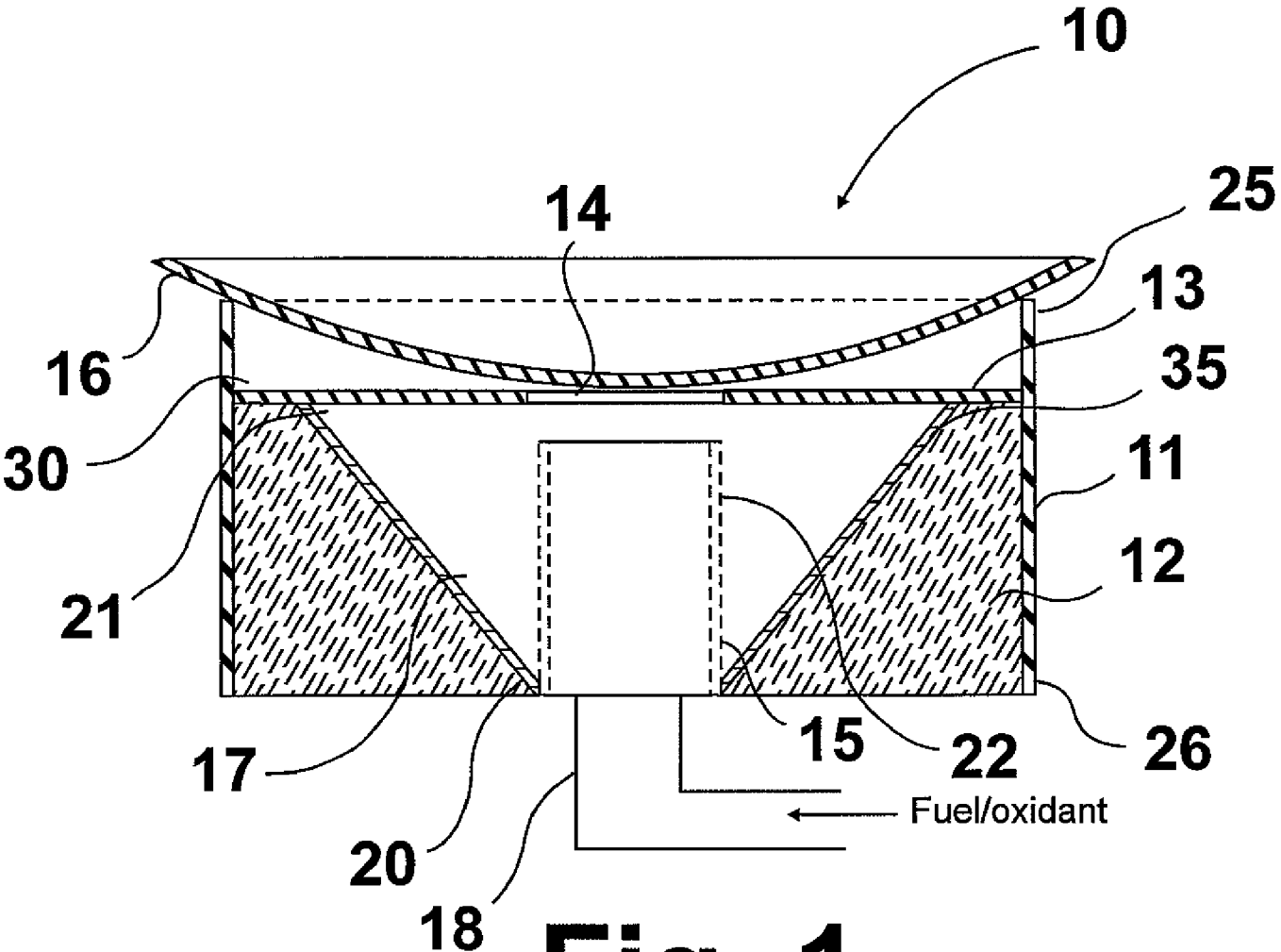
FIG. 1 is a lateral cross-sectional view of a wok heater in accordance with one embodiment of this invention.

Shown in FIG. 1 is an infrared wok heater 10 in accordance with one embodiment of this invention comprising a block of refractory material 12 forming an inverted frustum-shaped cavity or opening 17 having a downward oriented apical end 20 and an upwardly oriented base end 21 and adapted to receive burner head 15 of a gas-fired burner 18, which burner may be an infrared burner or a blue flame burner, to which a mixture of a fuel gas and a combustion oxidant is provided for combustion of the fuel gas within the cavity or opening 17. The block of refractory material 12 is made of a material which, upon heating to an elevated temperature, emits infrared radiation. Burner head 15 is designed to produce a laterally directed flame upon ignition of the mixture of a fuel gas and a combustion oxidant supplied to the burner. In accordance with one embodiment of this invention, burner head 15 comprises at least one vertical oriented porous mesh material 22 having sizes of pore or openings sufficient not only to anchor the flame, but also to maintain the flame as short as possible, so as to preclude contact between the flame and the block of refractory material. The sizes of pores or openings are preferably in the range of about 0.25 mm to about 0.5 mm across.

Refractory block 12 in accordance with one embodiment of this invention is disposed within a vertically oriented cylindrical housing 11 having a top end 25 and a bottom end 26. Top end 25 of cylindrical housing 11 provides support means for supporting a cooking wok 16 or other cooking vessel above the burner head 15. Base end 21 of inverted frustum-shaped opening or cavity 17 is covered by a planar structure 13 which forms at least one opening 14 for exhausting of the combustion products. In accordance with one preferred embodiment, the at least one opening 14 is located so as to create a chimney effect whereby the hot combustion products generated by the combustion of the mixture of fuel gas and combustion oxidant within the cavity and exhausted from the cavity contact the center of the wok, thereby increasing heat transfer for cooking. During operation, the infrared radiation emitted by the block of refractory material heats the planar structure 13 which, in turn, radiates heat to the remaining portions of the wok, thereby substantially evenly heating the remaining portions of the wok. Planar structure 13 may be made of any material capable of withstanding the operating conditions of the wok heater and emitting infrared radiation. Preferred materials include ceramics, glass ceramics, and stainless steel. To ensure that the combustion products are exhausted only through the provided openings, the peripheral region 30 of the planar structure 13 is sealed around the periphery of the planar structure by any suitable sealing means with the block of refractory material. Suitable sealing means include heat resistant gasket materials, binders or cements. It will also be appreciated that, by virtue of this design, the amounts of spills and food particles expelled from the wok during the cooking process that come into contact with, or fall past, the burner head are reduced compared with conventional wok heaters.

For those occasions in which spills or food particles expelled from the wok during the cooking process fall past the burner head onto the infrared radiating surface of the refractory block 12, in accordance with one embodiment of this invention, the radiating surface is substantially sealed so as to enable spills to be easily wiped up. In accordance with another embodiment of this invention, the radiating surface is covered with a metal plate 35 which is made of a metal able to withstand the operating conditions of the heater and which emits infrared radiation during operation of the heater, e.g. stainless steel.

As previously indicated, one of the benefits of the design of the wok heater of this invention is a reduction in heat loss to the top of the range. This reduction is accomplished, at least in part, by the block of refractory material which, in addition to emitting infrared radiation for the cooking process, acts as an insulating material which reduces the amount of heat transferred to the cylindrical housing which, in turn, reduces the amount of heat transferred through the cylindrical housing to the range top.

Figure 2:
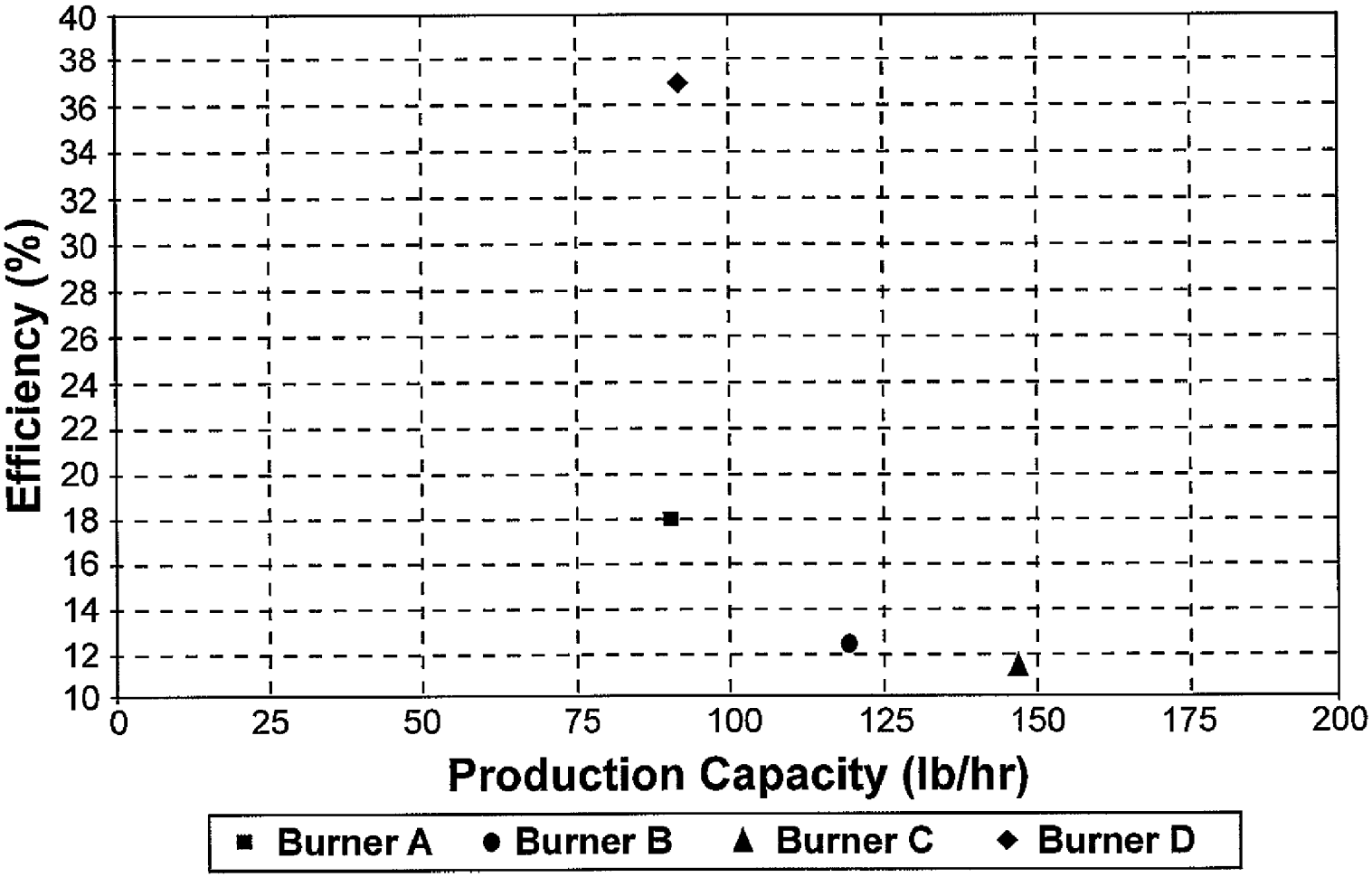
FIG. 2 is a diagram showing the efficiency of a wok heater of this invention as a function of production capacity compared with state-of-the-art wok heaters.

Testing of the wok heater in accordance with one embodiment of this invention was carried out in accordance with the ASTM "Standard Test Method for Performance of Chinese (Wok) Ranges", Designation:F 1991-99 (Reapproved 2005) and the results compared with the results obtained from the testing of state-of-the-art wok heaters. FIG. 2 shows the efficiency of the wok heater in accordance with one embodiment of this invention as a function of production capacity. In accordance with the ASTM standard, production capacity is defined as the maximum rate (lb/h) at which a Chinese range heats water in a wok from a temperature of about 70° F. to about 200° F. under full input rate in accordance with the ASTM test method. Burner firing rate is the firing rate of the wok heater during the test procedure. Efficiency is defined as the ratio of the amount of energy into the water to the burner firing rate. As shown in FIG. 2, the wok heater in accordance with one embodiment of this invention (Burner D) had an efficiency of about 37% compared with efficiencies in the range of about 11% to about 18% for state-of-the-art wok heaters (Burners A, B and C).

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. An infrared heater for heating a cooking vessel, the heater comprising:

a block of refractory material forming an inverted frustum-shaped opening having a downward oriented apical end and an upward oriented base end, said refractory material emitting infrared radiation upon being heated to an elevated temperature;

a gas-fired burner extending through said apical end of said inverted frustum-shaped opening having a burner head which produces a laterally directed flame upon ignition of a mixture of a fuel gas and a combustion oxidant supplied to said burner;

a planar structure suitable for emitting infrared radiation upon heating to an elevated temperature disposed over said upward oriented base end of said inverted frustum-shaped opening; and support means for supporting said cooking vessel above said block of refractory material.

2. The infrared heater of claim 1, wherein said planar structure forms at least one opening for exhausting combustion products generated by said flame.

3. The infrared heater of claim 1, wherein said burner head comprises a vertically oriented porous mesh material.

4. The infrared heater of claim 1, wherein a vertically oriented housing is disposed around said block of refractory material, said housing having a top end extending above a level of said planar structure for supporting said cooking vessel.

5. The infrared heater of claim 1, wherein said planar structure is constructed of a material selected from the group consisting of ceramics, glass ceramics, and stainless steel.

6. An infrared wok heater comprising:

a gas-fired burner having a burner head which produces a laterally directed flame upon ignition of a mixture of a fuel gas and a combustion oxidant supplied to said burner;

a block of refractory material forming an inverted frustum-shaped cavity having a downward oriented apical opening and an upward oriented base opening defining a combustion chamber in which said burner head is disposed whereby said flame heats said block of refractory material to an elevated temperature at which said block of refractory wall emits infrared radiation;

a planar structure disposed over said upward oriented base opening, said planar structure forming at least one exhaust gas opening for exhausting combustion products generated by said flame;

seal means for sealing a periphery of said planar structure with said block of refractory material, whereby passage of said combustion products around said periphery of said planar structure is substantially precluded; and support means for supporting a wok above said planar structure such that said combustion products exhausted through said at least one exhaust gas opening impinge upon a bottom of said wok.

7. The infrared wok heater of claim 6, wherein a vertically oriented housing is disposed around said block of refractory material, said housing having a top end extending above a level of said planar structure for supporting said wok.

8. The infrared wok heater of claim 6, wherein said burner head comprises a vertically oriented porous mesh material.

9. The infrared wok heater of claim 6, wherein said planar structure is constructed of a material selected from the group consisting of ceramics, glass ceramics, and stainless steel.

* * * * *